US006802802B2

(12) United States Patent
Woog

(10) Patent No.: US 6,802,802 B2
(45) Date of Patent: Oct. 12, 2004

(54) BEVERAGE CARRIER

(75) Inventor: Gunter Woog, West Bend, WI (US)

(73) Assignee: USI International, Inc., West Bend, WI (US)

( * ) Notice: Subject to any disclaimer, the term of this patent is extended or adjusted under 35 U.S.C. 154(b) by 104 days.

(21) Appl. No.: 10/150,525

(22) Filed: May 17, 2002

(65) Prior Publication Data

US 2003/0213705 A1 Nov. 20, 2003

(51) Int. Cl.[7] ..... B31B 1/64

(52) U.S. Cl. ..... 493/129; 493/51; 493/137; 493/226; 206/141; 206/162; 206/427; 206/545; 62/457.5

(58) Field of Search ..... 206/141, 162, 206/167, 163, 168, 169, 427, 549, 545; 229/101; 493/133, 137, 221, 189, 51, 101, 123, 129, 226; 62/457.5, 457.4

(56) References Cited

U.S. PATENT DOCUMENTS

| | | | | | |
|---|---|---|---|---|---|
| 2,860,816 | A | | 11/1958 | Fielding | |
| 3,605,435 | A | | 9/1971 | Taylor | |
| 3,677,458 | A | * | 7/1972 | Gosling | 229/120.011 |
| 4,096,985 | A | * | 6/1978 | Wood | 206/427 |
| 4,238,069 | A | | 12/1980 | Morris, Jr. | |
| 4,531,381 | A | | 7/1985 | Toro et al. | |
| 4,836,367 | A | * | 6/1989 | Golkar | 206/200 |
| 4,858,444 | A | | 8/1989 | Scott | |
| 4,899,553 | A | | 2/1990 | Drummond, III | |
| 5,040,672 | A | | 8/1991 | DeMaio et al. | |
| 5,094,359 | A | * | 3/1992 | DeMars et al. | 229/101 |
| 5,423,478 | A | | 6/1995 | Roosa | |
| 5,558,224 | A | | 9/1996 | Fogle | |
| 6,058,733 | A | | 5/2000 | Morgan | |
| 6,164,526 | A | | 12/2000 | Dalvey | |

* cited by examiner

*Primary Examiner*—David T. Fidei
(74) *Attorney, Agent, or Firm*—Philip M. Weiss; Weiss & Weiss

(57) ABSTRACT

A carrier for beverage containers formed of a sheet material such as plastic or paperboard which includes a bottom panel attached to side panels, a pair of opposed end panels connected to the bottom and side panels, and a central handle formed of two halves folded together in a first position for ease in carrying. The handle is pivotal to an open position along its top fold line, allowing the carrier to spread outwardly to form a central cavity capable of holding ice for the purpose of cooling the beverage containers. The top panels are provided with a plurality of openings, for example, six or eight, each of which is adapted to receive a beverage container. The method for forming the beverage container is disclosed.

3 Claims, 7 Drawing Sheets

BEVERAGE CARRIER

BACKGROUND OF THE INVENTION

The present invention relates to a beverage carrier suitable for sale and transportation of beverages in containers such as cans or bottles, and which also may serve as a disposable cooler for the containers.

Collapsible paperboard carriers for beverages contained in cans or bottles are commonplace in the industry. Examples of various such carriers are shown in U.S. Pat. No. 2,860,816 issued Nov. 18, 1958 and U.S. Pat. No. 5,040,672 issued Aug. 20, 1991. Such carriers are examples of one of the many types of commercially used packaging used in the transportation and sale of canned and bottled beverages such as soda, beer, wine coolers, etc. My earlier patent application Ser. No. 09/782,113, now U.S. Pat. No. 6,360,558 describes an adaptation of a common beverage package that enables the same to perform a dual function wherein it also serves as an ice-containing cooler for the beverage containers.

SUMMARY OF THE INVENTION

The present invention relates to a novel adaptation of a common beverage six-, eight-, or other carrier which enables the same to perform a dual function wherein it also may serve as an ice-containing cooler for the beverage containers while, yet, minimizing the retail shelf space required to display the carrier for sale. The cooler may be either disposable either after a single use or, optionally, after multiple uses.

Briefly summarized, the invention provides a carrier for beverage containers formed of a sheet material such as plastic or paperboard which includes a bottom panel attached on opposite lateral sides to side panels, a pair of opposed end panels connected at their lower peripheries to the bottom and side panels, and a central handle which is formed of two halves folded together in a first position for ease in carrying and for economy of display space for retail sale display. The handle is pivotal to an open position along its top fold line, allowing the carrier to spread outwardly to form a central interior cavity capable of holding ice for the purpose of cooling the beverage containers. Each end panel is also provided with pleated panels that enable the outwardly opened carrier to be capable of providing a tray that holds ice and resultant water after melting of the ice. The pleated panels are integrally connected to a flat, rectangular panel of the end panels, which in turn is connected to the peripheries of the side panels. The carrier has a pair of top panels that are provided with a plurality of openings, for example, six or eight, each of which is adapted to receive a beverage container. While eight openings are used in the preferred embodiment, it will be understood that other configurations having four, six or even twelve openings can be used. Alternatively, the carrier may be provided with two larger storage spaces, rather than separate openings. The top panels, which are preferably connected to the handle along their internal lateral edges, are also integrally connected at opposite sides to the upper edges of the side panels. The interior of the carrier may be provided with waterproof protective inner coating or a lining, which may be a flexible plastic sheet material such as polyethylene or polypropylene or a wax-like substance.

The invention may also be equipped with a microchip that would relay an audio display when the invention is moved from a closed to an open position.

Also, the invention explains a method for forming the beverage containers in either paperboard or plastic form.

The invention will be further set forth in the detailed description, accompanying claims and in the drawings.

DETAILED DESCRIPTION OF THE INVENTION

Figure 1:
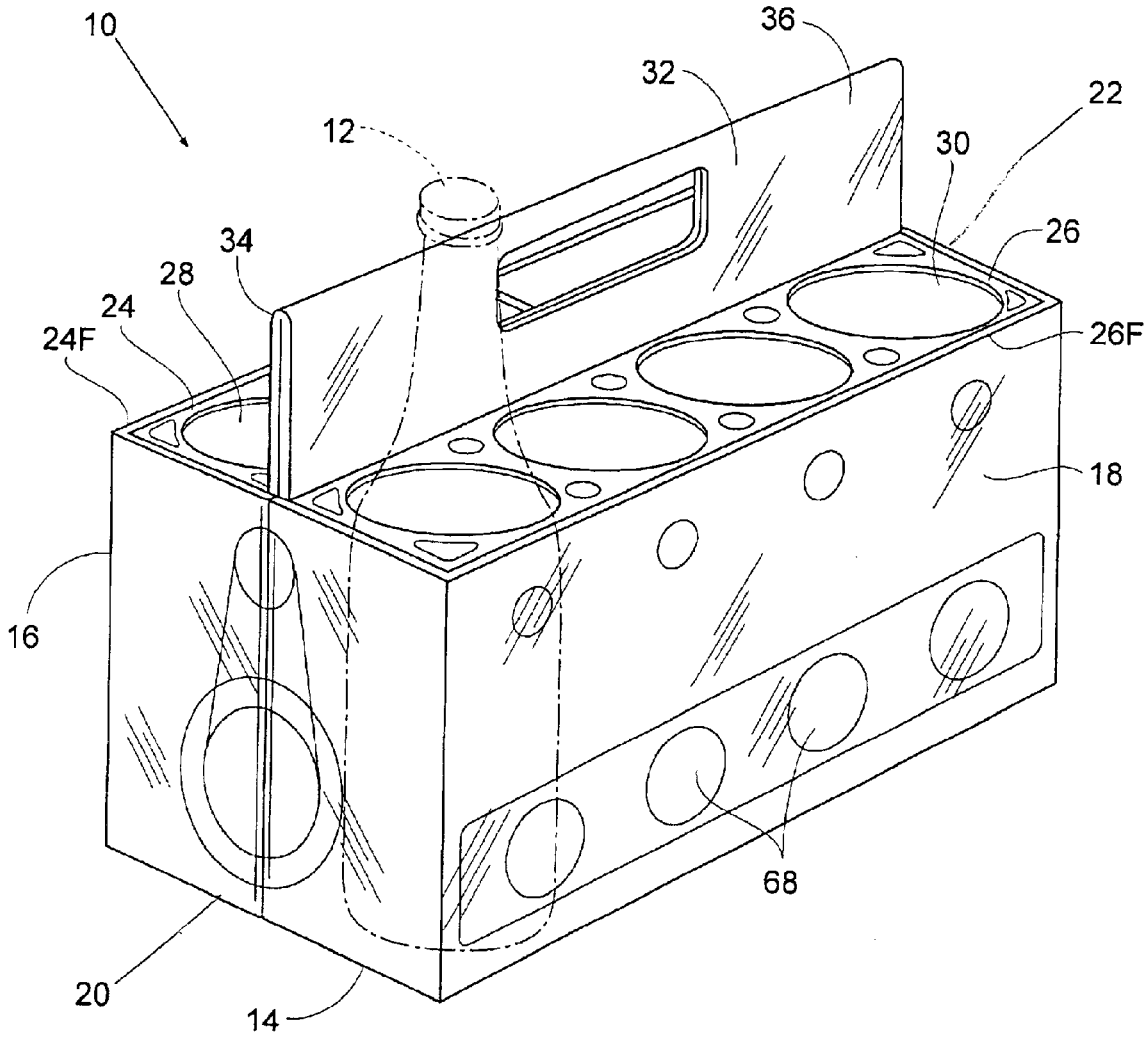
FIG. 1 is a perspective view illustrating a carrier/cooler of the present invention in conjunction with bottled beverages.
Figure 2:
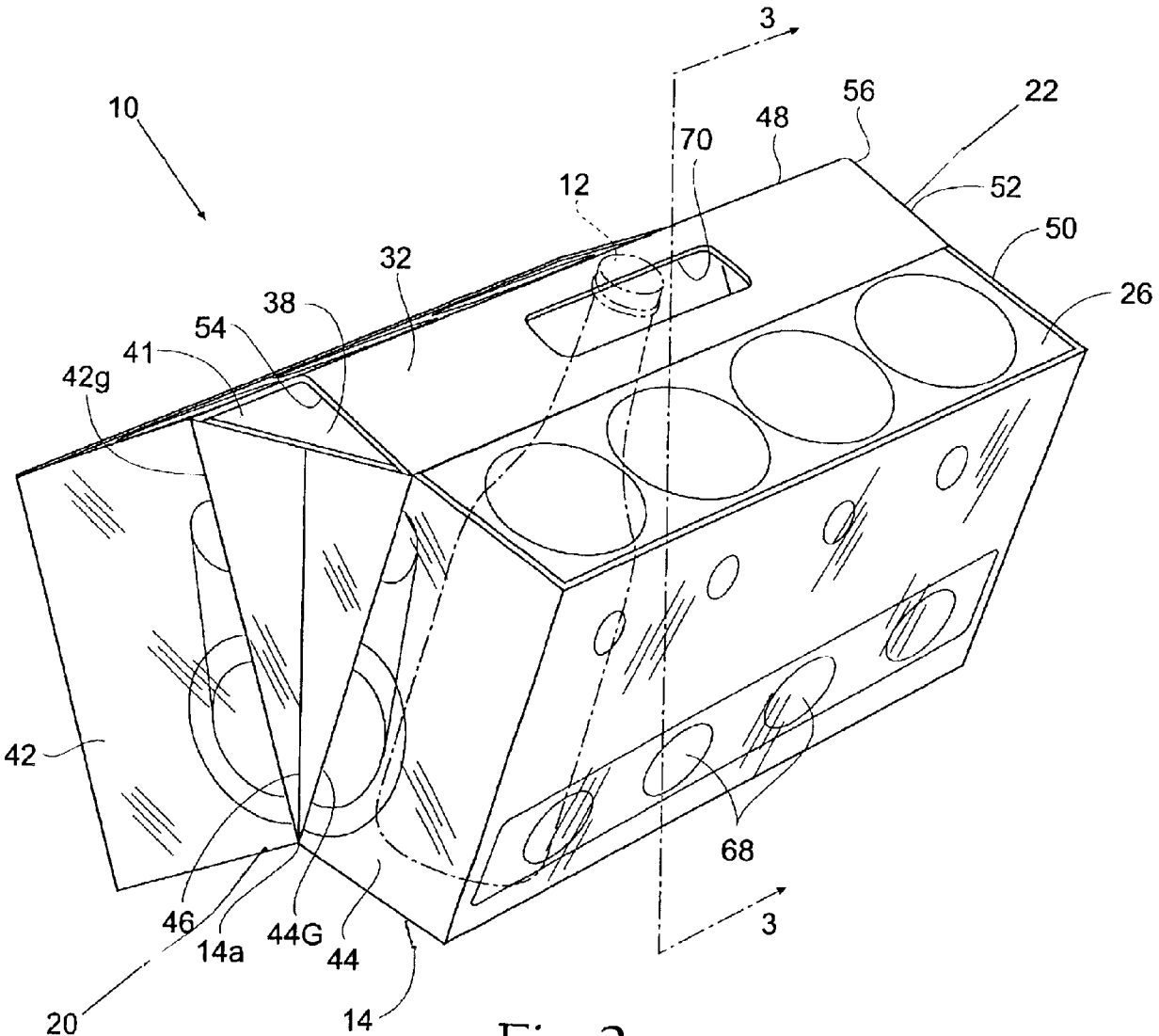
FIG. 2 is a perspective view of the embodiment shown in FIG. 1, but showing the device in the open position to accept ice or other chill product.

Referring more particularly to the drawings, FIGS. 1 and 2 show a carrier device 10 of the present invention. In the illustrated embodiment, carrier 10 is designed to contain eight individual beverage containers, which in the illustrated embodiment are conventional beverage bottles 12.

Referring particularly to FIG. 1, carrier 10 is formed from a sheet material such as paperboard or, alternatively, of a plastic material, such as polyethylene, polypropylene, or any other similar type substance. Carrier 10 is defined by a bottom panel 14, which has a pair of side panels 16 and 18 attached on each lateral side and extending upwardly from said bottom panel 14. The side panels 16 and 18 are also connected to a pair of opposed end panels 20 and 22. The upper edges 24F and 26F of the side panels 16 and 18, respectively, are integrally connected to a pair of top panels 24 and 26, respectively. A plurality of openings 28 and 30 are provided in the top panels 24 and 26, respectively for access to and display of the containers 12. The top panels 24 and 26 are also integrally connected at their opposed edges to the end panels 20 and 22. The upper edges of the side panels 16 and 18, as well as the end panels 20 and 22, are all integrally connected to the top panels 24 and 26. The top panels 24 and 26 are integrally connected along their internal lateral sides to a central handle 32. The handle 32 is formed of two folded halves of material, 34 and 36.

Referring to FIG. 2, the end panels 20 and 22 each are made up of three panels, 42, 44, and 46, and 48, 50, and 52, respectively. The panels 42 and 44 of the end panel 20 are flat, quadrilateral panels. The internal longitudinal edges 42G and 44G of the panels 42 and 44 connect to the edges of the internal panel 46, which is triangular in shape and pleated inwardly along a central axis 54. The panels 48, 50, and 52 of the end panel 22 are connected in a similar fashion as the panels of the end panel 20, with the central panel 52 being triangular in shape and also pleated along a central axis 56.

Still referring to FIG. 2, the handle 32 is pivotally moved outward to form an enlarged cavity 38, with through opening 41. Access through the opening 41 enables filling of the cavity 38 of the carrier with ice cubes 40 (see FIG. 3), as desired. The inverted pyramidal cavity 38 is defined by the unfolded central side panels 46 and 52 and a pair of internal walls 58 and 60 of the carrier 10. The internal walls 58 and 60 are connected at a common foldable divider line 14*a* of the bottom panel 14. The expanded handle 32 can also act as an insulator to slow the melting process of the ice cubes 40.

The carrier 10 may be adorned with markings 68. Also, a microchip 70 may be placed within the handle 32 so that an audio display results when the handle 32 is pivotally moved outward. Alternatively, the microchip could be placed anywhere within the carrier 10 where it would be activated as the carrier 10 is moved to an open position. The microchip 70 is suitable to be used on any perceived embodiments of the present invention. Together the markings 68 and the microchip 70 can give one the appearance of an engine block when the carrier 10 is in the open position and enhance the use and enjoyment of the carrier 10.

Figure 3:
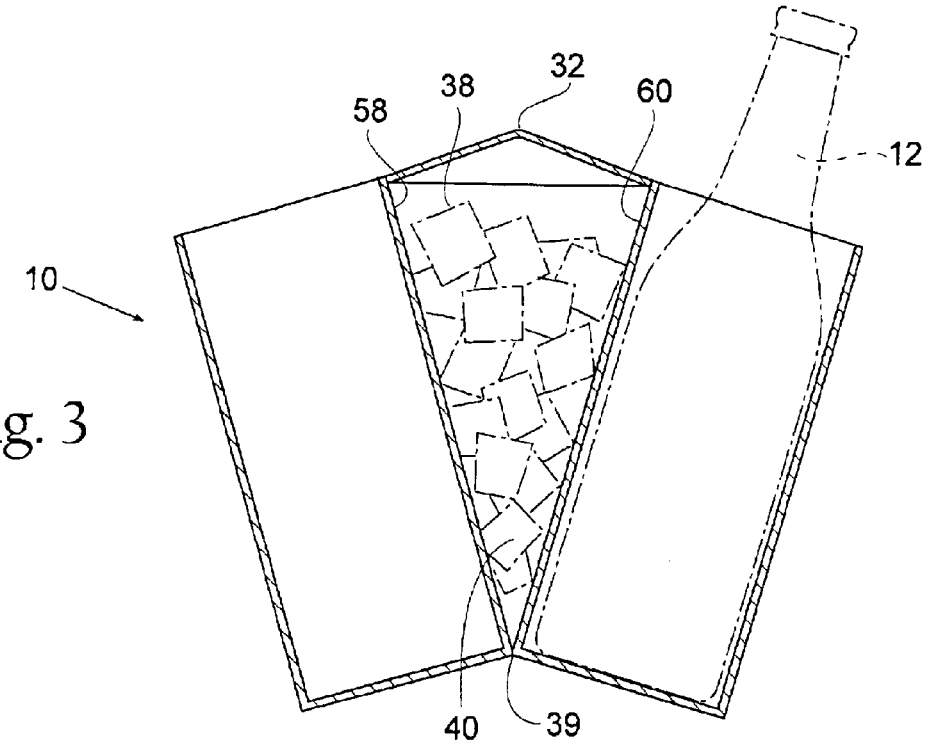
FIG. 3 is a cross-sectional view of the invention in FIG. 2, taken along line 3—3 thereof and showing ice in place in the resultant cavity.

Referring to FIG. 3, a cross-sectional view of FIG. 2 of the carrier 10 is shown with the ice cubes 40 placed in the resultant cavity 38. The ice cubes 40 rest along the internal panels 58 and 60 of the carrier 10 to cool the container 12. The handle 32 acts as a cover for the ice 40.

Figure 4A:
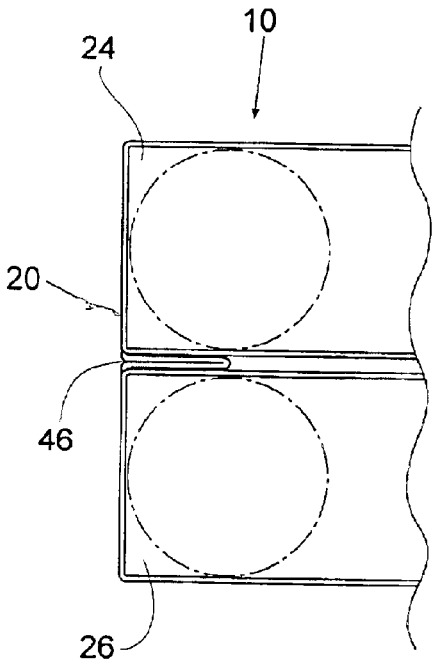
FIG. 4A is a fragmentary top view of an end of the device in the closed position and showing a folded end panel.

Referring to FIG. 4A, a fragmentary top view of an end of the carrier 10 in the closed position is shown. The central pleated panel 46 of the end panel 20 is shown folded inwardly. When the carrier 10 is in the closed position, it will be easier to transport and store the carrier 10.

Figure 4B:
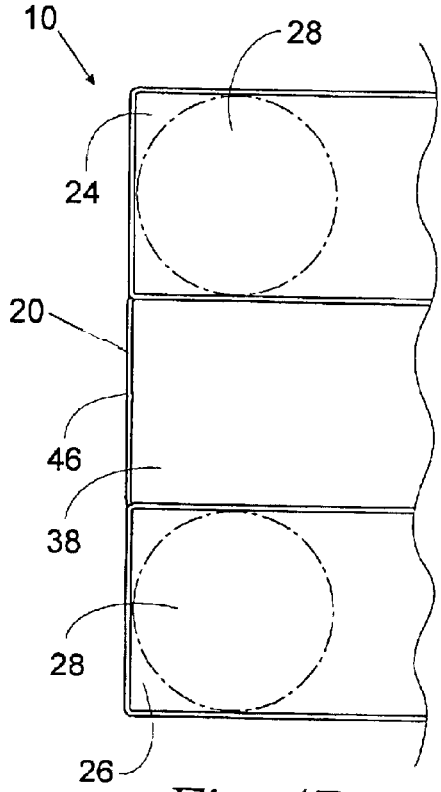
FIG. 4B is a fragmentary top plan view, similar to that of FIG. 4A, but showing the device in the open position and an unfolded, flattened end panel.

Referring to FIG. 4B, a fragmentary top view of an end of the carrier 10 in an open position is shown. The central panel 46 of the end panel 20 is expanded, forming the cavity 38. The open position allows the carrier 10 to be used to cool the containers 12 (not shown) or other products, which are placed within the openings 28 and 30 of the top panels 24 and 26.

Figure 5A:
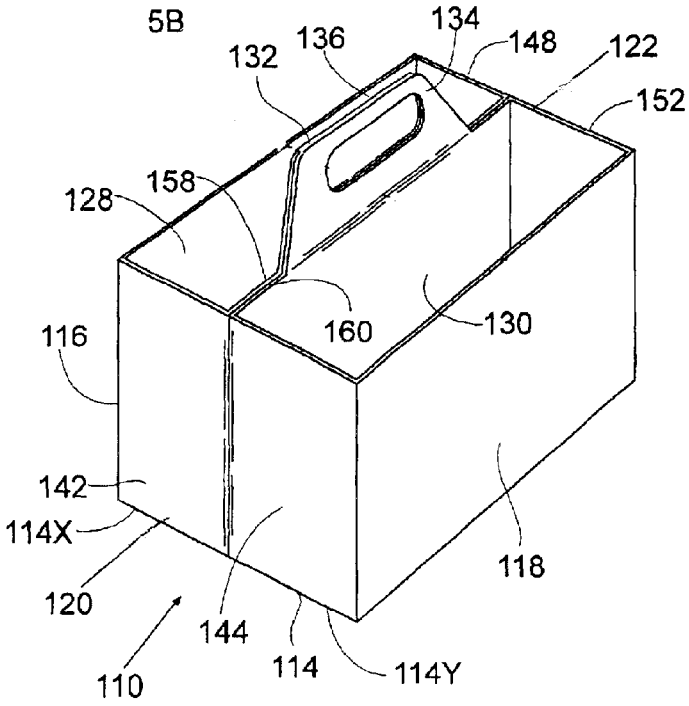
FIG. 5A is a perspective view of an alternative embodiment of the present invention.
Figure 5B:
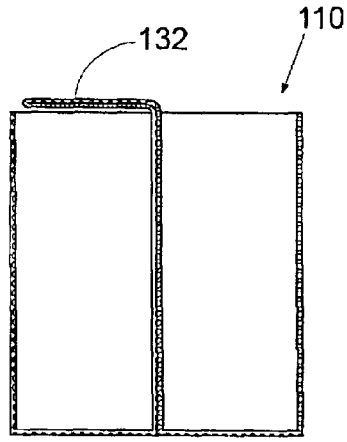
FIG. 5B is an end view of the embodiment shown in FIG. 5A.
Figure 5C:
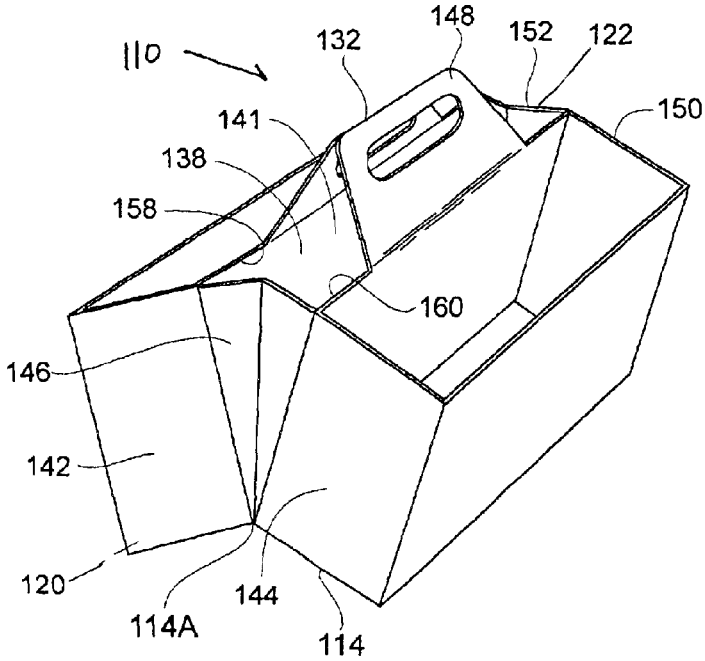
FIG. 5C is a perspective view of the embodiment shown in FIGS. 5A and 5B, but illustrating the opened position.

Referring now to FIGS. 5A, 5B, and 5C, another embodiment of the invention is shown. In this embodiment the carrier 110 is designed to carry more than just beverages, but other food products or objects, as well.

Referring particularly to FIG. 5A, carrier 110 is formed from a sheet material such as paperboard or, alternatively, of a plastic material. Carrier 110 is defined by a bottom panel 114, which has side panels 116 and 118 attached on each lateral side, and extending upwardly from said bottom panel 114. The side panels 116 and 118 are also connected to a pair of opposed end panels 120 and 122. The top of the carrier 110 is open, thereby forming storage areas 128 and 130. The storage area 128 is defined by a bottom panel portion 114X of the bottom panel 114, the side panel 116, an internal panel 158 of the carrier 110, a flat quadrilateral panel 142 of the end panel 120 and a flat quadrilateral panel 148 of the end panel 122. The storage area 130 is defined by a bottom panel portion 114Y of the bottom panel 114, the side panel 118, an internal panel 160 of the carrier 110, a flat panel 144 of the end panel 120 and the panel 150 of the end panel 122. A handle 132 is formed of two folded halves of material, 134 and 136. The handle 132 is integrally connected along the upper edges of the internal panels 158 and 160.

Referring particularly to FIG. 5B, a side view of FIG. 110 is shown. The handle 132 is folded over to one side of the carrier 110, thereby allowing multiple containers 110 to be easily stacked and stored upon one another.

Referring to FIG. 5C the carrier 110 of FIGS. 5A and 5B is shown in an open position. The end panels 120 and 122 each are made up of three panels, 142, 144, and 146, and 148, 150, and 152, respectively. The panels 142 and 144 of the end panel 120 are flat, rectangular panels. The internal longitudinal edges of the panels 142 and 144 connect to the edges of the internal panel 146, which is triangular in shape and pleated inwardly along a central axis 154. The panels 148, 150, and 152 of the end panel 122 are connected in a similar fashion as the panels of the end panel 120, with the central panel 152 being triangular in shape and pleated inwardly along a central axis 156.

Still referring to FIG. 5C, handle 132 is pivotally moved outward to form an enlarged cavity 138, with access through opening 141. Access through opening 141 enables filling of the cavity 138 of the carrier 110 with ice cubes 40 (not shown), as desired. The inverted pyramidal cavity 138 is defined by the unfolded central end panels 146 and 152 and internal panels 158 and 160 of the beverage carrier 110. The internal walls 158 and 160 are connected at a common foldable divider line 114A of the bottom panel 114. The expanded handle 132 can also act as an insulator to slow the melting process of the ice cubes 40 (not shown).

Figure 6A:
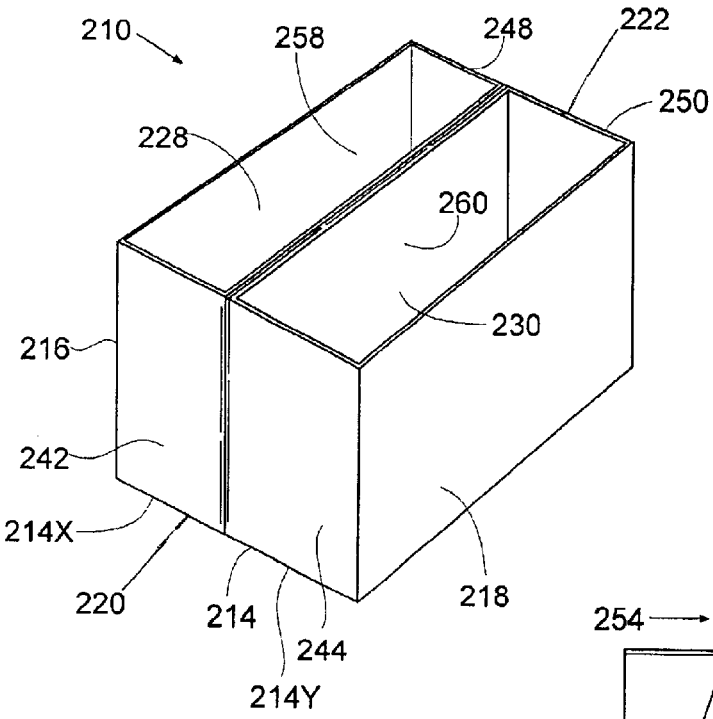
FIG. 6A is a perspective view of another alternative embodiment and illustrating a loop-type handle.
Figure 6B:
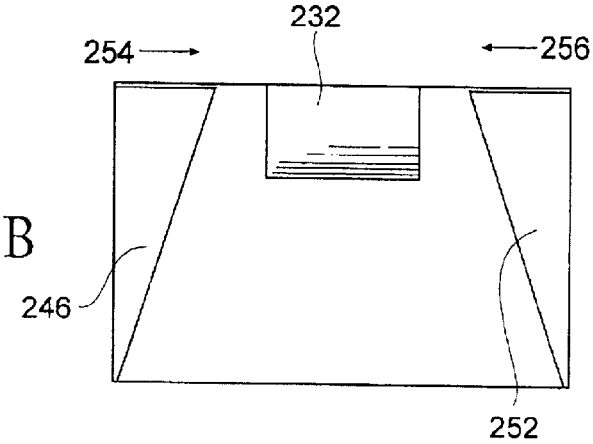
FIG. 6B is a cutaway view of the device shown in FIG. 6A as seen from the central axis of the device.
Figure 6C:
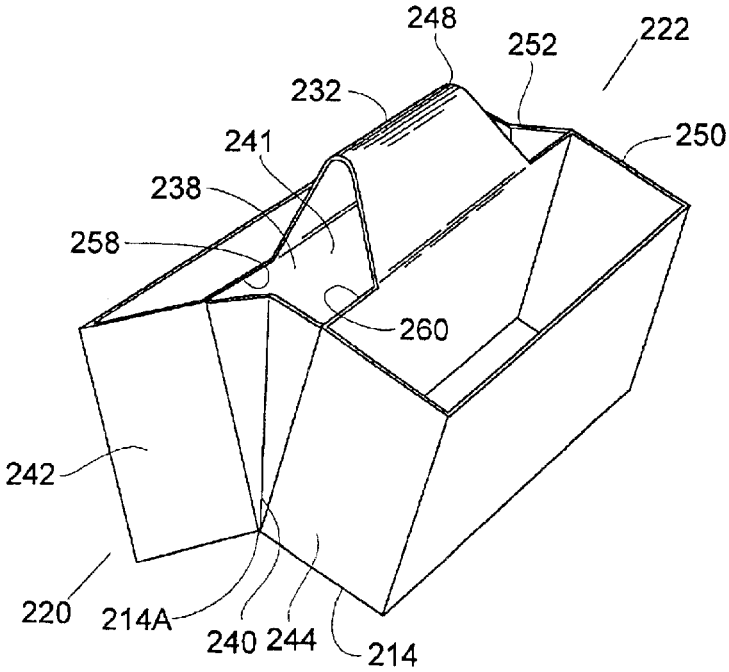
FIG. 6C is a perspective view of the device shown in FIGS. 6A and 6B, but illustrating the opened position.

Another embodiment of the invention is shown in FIGS. 6A, 6B, and 6C. In this embodiment, a carrier 210 is designed with a handle 232 (FIGS. 6B & 6C) that may be folded inside of the carrier 210 for easier stacking of multiple carriers.

Referring particularly to FIG. 6A, carrier 210 is formed from a sheet material such as paperboard or, alternatively, of a plastic material. The carrier 210 is defined by a bottom panel 214, which has side panels 216 and 218 attached on each lateral side and extending upwardly from said bottom panel 214. The side panels 216 and 218 are also connected to opposed end panels 220 and 222. The top of the carrier 210 is open, thereby forming storage areas 228 and 230. The storage area 228 is formed by a bottom panel portion 214X of the bottom panel 214, the side panel 216, an internal panel 258 of the carrier 210, a flat panel 242 of the side panel 220 and a flat panel 248 of the side panel 222. The storage area 230 is formed by a bottom panel portion 214Y of the bottom panel 214, the side panel 218, an internal panel 260 of the carrier 210, a flat panel 244 of the side panel 220 and a flat panel 250 of the side panel 222. The handle 232 is formed of a pliable loop of material, thereby allowing the handle to be folded inwardly of the carrier 210. The handle 232 is integrally connected along the upper edges of the internal panels 258 and 260, and is folded inwardly between the internal panels 258 and 260.

Referring in particular to FIG. 6B a sectional view of the carrier 210 described in FIG. 6A and taken along line 6A—6A is shown. The panels 246 and 252 are shown folded inwardly along central axes 254 and 256, respectively. The handle 232 is folded inwardly of the carrier 210.

Referring to FIG. 6C the carrier 210 of FIG. 6A and 6B is shown in an open position. The end panels 220 and 222 each are made up of three panels, 242, 244, and 246, and 248, 250, and 252, respectively. The panels 242 and 244 of the end panel 220 are flat, quadrilateral panels. The internal longitudinal edges of the panels 242 and 244 connect to the edges of the internal panel 246, which is triangular in shape and pleated inwardly along the central axis 254 (See FIG. 6B). The panels 248, 250, and 252 of the end panel 222 are connected in a similar fashion as the panels of the end panel 220, with the central panel 252 being triangular in shape and pleated along the central axis 256 (See FIG. 6B).

Still referring to FIG. 6C, handle 232 is pivotally moved outward to form an enlarged cavity 238, with access through opening 241. Access through opening 241 enables filling of the cavity 238 of the carrier 210 with ice cubes 40, as desired. The pyramidal cavity 238 is defined by the unfolded central end panels 246 and 252 and internal walls 258 and 260 of the carrier 210. The internal walls 258 and 260 are connected at a common foldable divider line 214A of the bottom panel 214. The expanded handle 232 is made of a flexible material.

Figure 7:
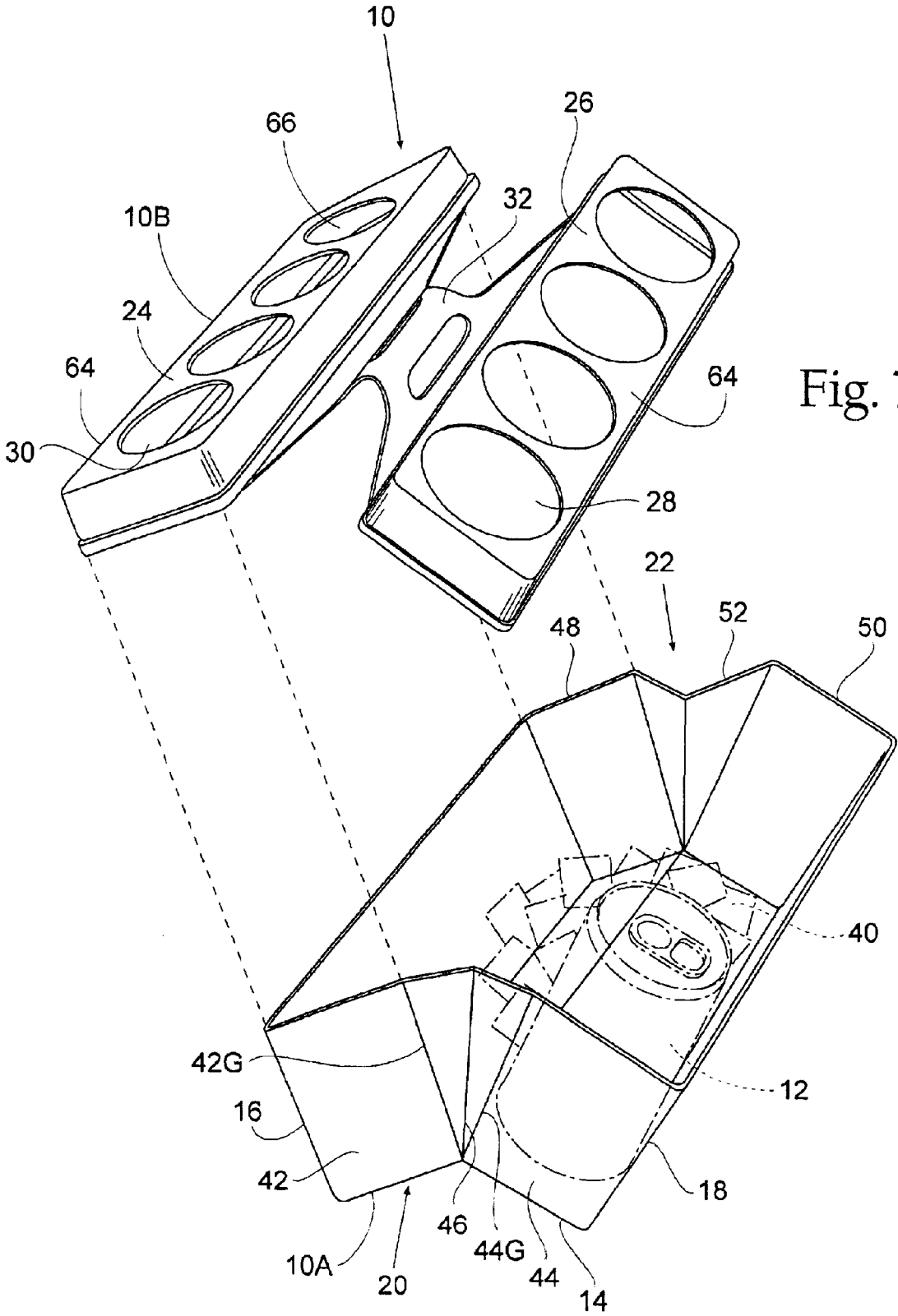
FIG. 7 is an exploded view of an embodiment of the present invention, whereby the invention is made with vacuum formed plastic parts.

FIG. 7 is an exploded view of the present invention, as it would be made with from a plastic material. The carrier 10 is designed from two vacuum formed parts, 10A and 10B. The formed part 10A comprises the bottom panel 14, the side panels 16 and 18, and the end panels 20 and 22. The end panel 20 is made up of three panels, the flat panels 42 and 44, and the triangular shaped pleated panel 46. The panels 42 and 44 are integrally connected to the pleated panel 46 along the edges 42G and 44G, respectively. The end panel 22 is made up of the three panels, 48, 50, and 52, in the same fashion as the end panel 20.

The formed part 10B comprises a cover and includes the handle 32 and the top panels 24 and 26. The top panels 24 and 26 contain the plurality of openings 28 and 30, respectively. The formed part 10B is welded electronically onto the formed part 10A. The carrier 10 made as shown in FIG. 7 preferably does not include the internal panels 58 and 60 (see FIG. 3). The ice cubes 40 are allowed to fall around the beverage container 12. The carrier 10, when formed, should allow the top of the beverage container 12 to be visible when the container 12 is placed within the carrier 10 through the openings 28 or 30.

Figure 8:
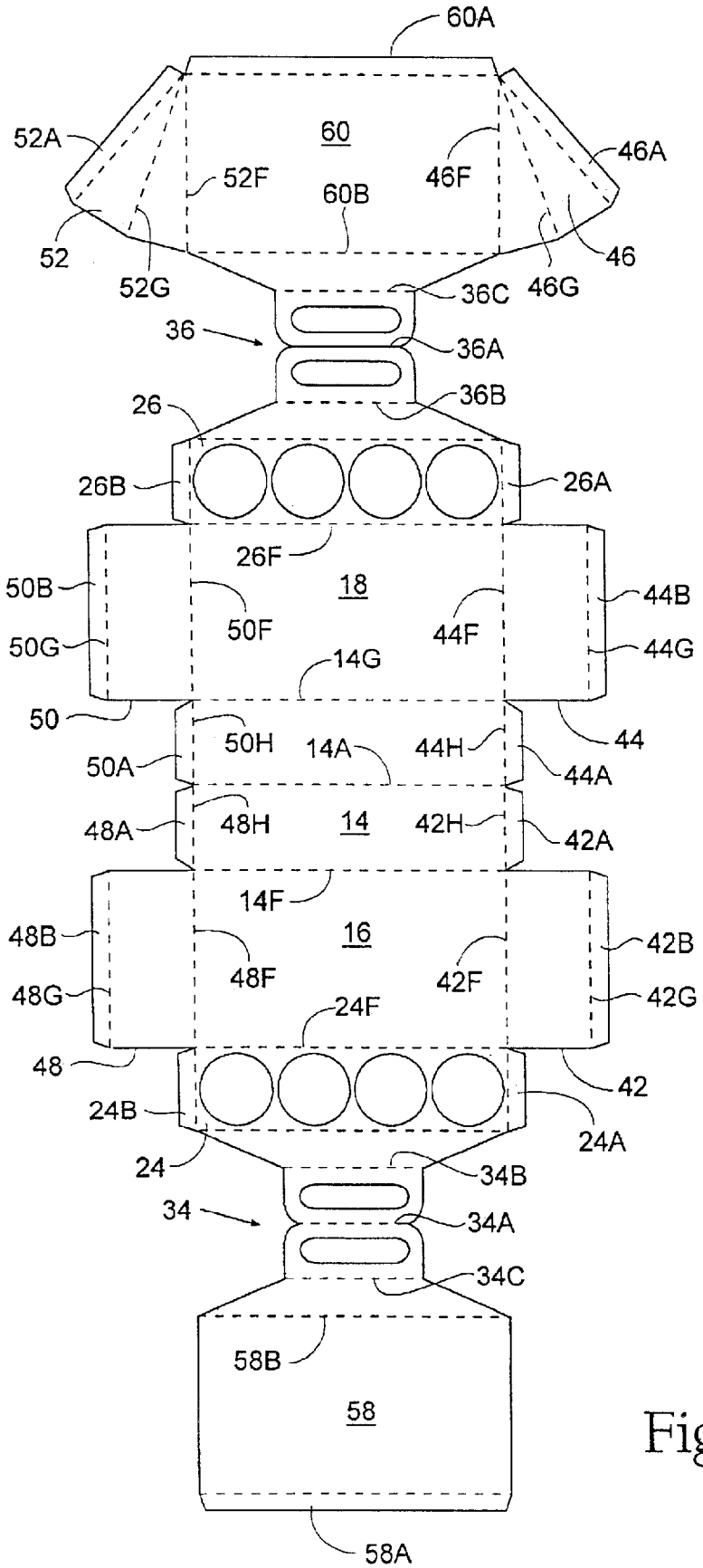
FIG. 8 is a plan view of one example of a template to be used in the manufacture of the present invention.

FIG. 8 shows a plan view of a blank template 11, which may be used in the manufacture of the carrier 10 of the present invention. One method of forming the carrier 10 includes the folding the blank 11 upwardly along fold lines 14F and 14G, leaving the blank 11 perpendicular to the bottom panel 14. Next, the flat panels 42, 44, 48, and 50 are folded inwardly along fold lines 42F, 44F, 48F, and 50F, respectively, so that the panels 42, 44, 48, and 50 are perpendicular to the blank 11 and also to the bottom panel 14.

Tabs 42A, 44A, 48A, and 50A are then folded along fold lines 42H, 44H, 48H, and 50H, respectively, so that the tabs 42A, 44A, 48A, and 50A are perpendicular to the base 14 and also parallel to the panels 42, 44, 48, and 50. Then, the tabs 42A, 44A, 48A, and 50A are fixedly secured to the panels 42, 44, 48, and 50, respectively, known in a manner such as with a water-resistant glue. Tabs 42B, 44B, 48B, and 50B are then folded inwardly along fold lines 42G, 44G, 48G, and 50G, respectively, so that the tabs 42B, 44B, 48B, and 50B are perpendicular to the bottom panel 14. The tabs 42B, 44B, 48B, and 50B are aligned along a central axis 14A of the bottom panel 14.

Next, the panels 46 and 52 are folded inwardly along fold lines 46F and 52F so that the panels 46 and 52 are flush with the inner panel 60. The panels 46 and 52 are then folded in half along fold lines 46G and 52G so that both halves of 46 and 52 are flush with the panel 60. Tabs 46A and 52A are folded inwardly so that they are flush with the panels 46 and 52, and, also, flush with the panel 60.

The handle halves 34 and 36 are folded inwardly towards the center of the carrier 10 along lines 34A and 36A and the folded over handles are fixedly secure to themselves. That is, the half 34 is secured to the folded over portion of 34, and the half 36 is secured to the folded over portion of 36. The inner panels 58 and 60 are folded outwardly along fold lines 58B and 60B, leaving the panels approximately perpendicular to the folded handle halves 34 and 36. Tabs 58A and 60A are folded inwardly so that they are perpendicular to the panels 58 and 60.

The top panels 24 and 26 are folded inwardly so that they are perpendicular to the side panels 16 and 18. Tabs 24A, 24B, 26A, and 26B are folded inwardly so that they are perpendicular to the top panels 24 and 26. The tabs 24A, 24B, 26A, and 26B are then fixedly secured to the panels 42, 48, 44, and 50, respectively.

The tabs 58A and 60A are then fixedly secured to the bottom panel 14 approximately near the axis 14A. The tabs 46A and 52A are fixedly secured to the flat panels 42 and 48 approximately along the fold lines 42G and 48G, respectively.

The handle halves 34 and 36 are then folded inwardly along lines 34B and 34C, and 36B and 36C, respectively, towards the central axis 14A, thus forming the cavity 38 (not shown).

While a method of folding and forming the carrier 10 has been shown, it is understood that a person skilled in the art could form the carrier in a similar fashion and not change the scope of the invention. Likewise, any securing materials could be employed to seal and form the carrier 10.

It is also desirable to provide the interior of carrier 10 with a protective inner lining of a flexible plastic sheet material for example polyethylene, polypropylene, etc., particularly in cases where the body of carrier 10 is formed from paperboard, which requires the benefit of a protective liner to avoid damage from the melting ice. As seen in FIG. 3, the liner may be in the form a somewhat heavier plastic tray liner 39, if desired.

It will be understood that if the sheet material from which the carrier 10 is itself formed of a plastic sheet material or molded plastic, the carrier will be provided with a longer life permitting reuse for the consumer.

The markings 68 may be provided, if desired, to give the carrier 10 the appearance of a mock engine block. Thus, the invention can be marketed as a novelty item to racecar enthusiasts.

It will be apparent to those skilled in the art that various modifications of the foregoing illustrative embodiment are possible. Thus, the invention also encompasses any and all embodiments within the scope of the following claims.

What is claimed is:

1. A method for forming a carrier, said method comprising the steps of:

providing a blank template of the carrier, said blank template including a bottom panel, a pair of opposed end panels, each said end panel comprised of a pair of flat panels and a pleated triangular panel, a pair of side panels, a pair of inner panels, a plurality of tabs, and a plurality of handle halves;

folding the blank template upwardly along the lateral edges of the bottom panel of said carrier;

folding the flat panels of said end panels inwardly so that the flat panels of said end panels are perpendicular to the blank template and the bottom panel;

folding tabs connected to the bottom panel inwardly of said blank template so that said bottom tabs are perpendicular to the flat panels and the bottom panel;

securing fixedly said tabs to the end panels;

folding tabs connected to the end panels inwardly so that said end tabs are perpendicular to the bottom panel;

folding the triangular pleated panels in half of the end panels of the blank template so that said folded panels are flush with one of the inner wall panels of said blank template;

folding the folded halves of said handle in half;

folding the inner panels of the blank template inwardly so that the inner panels are approximately perpendicular to said folded handle halves;

folding tabs connected to the inner panels inwardly;

folding inwardly the top panels of the blank template;

folding inwardly the tabs connected to the top panels;

securing the triangular pleated panels to the flat panels of said end panels;

securing the top panel tabs to the flat end panels; and securing the inner panel tabs to the bottom panel of the blank template.

2. A method according to claim 1, where the panels and tabs are connected with a water resistant material.

3. A method for forming a carrier, said method comprising the steps of:

vacuum-forming a first plastic part, said first plastic part comprising a handle and a pair of top panels, said top panels having a plurality of openings;

vacuum-forming a second plastic part, said second plastic part comprising a bottom panel, a pair of side panels extending laterally upward from the bottom panel, and a pair of end panels extending laterally upward from the bottom panels, said end panels each comprising a pair of flat panels and a pleated triangular panel, said pair of flat panels connected to the edges of the pleated triangular panel; and electronically welding the first vacuum-formed part fittingly onto the second vacuumed-formed part.

* * * * *